United States Patent [19]

Willmott

[11] Patent Number: 4,981,444

[45] Date of Patent: Jan. 1, 1991

[54] STRAIN RELIEF ASSEMBLY

[75] Inventor: Colin B. Willmott, Buffalo Grove, Ill.

[73] Assignee: The Chamberlain Group, Inc., Elmhurst, Ill.

[21] Appl. No.: 447,185

[22] Filed: Dec. 7, 1989

[51] Int. Cl.[5] ..... H01R 13/58

[52] U.S. Cl. ..... 439/459; 174/153 G

[58] Field of Search ..... 174/153 G; 248/56; 435/456, 457, 459

[56] References Cited

U.S. PATENT DOCUMENTS

| | | | |
|---|---|---|---|
| 2,420,826 | 5/1947 | Irrgang | 174/153 G |
| 2,831,087 | 4/1958 | Sundt | 174/153 G |
| 3,953,665 | 4/1976 | Nicholson | 174/153 G |

OTHER PUBLICATIONS

Heyco, Flex Catalog 187, "Bushings & Beyond", p. 6.

*Primary Examiner*—Eugene F. Desmond

*Attorney, Agent, or Firm*—Fitch, Even, Tabin & Flannery

[57] ABSTRACT

A strain relief assembly including a clamp for firmly holding an electrical cable which includes at least one electrical conductor and a resilient insulative outer jacket disposed about the conductor. The cable is for extension inside a housing for electrical equipment, and the housing has a wall with a generally circular opening for passage of the cable. The strain relief clamp is for mounting in the opening and includes a generally U-shaped receiver defining an open-ended cavity for receiving the cable. The clamp also includes an insert for slidable reception by the receiver to close the open end of the cavity thereby holding the cable by forming a bend in the cable with the resiliency of the cable urging the insert outwardly. The housing wall and the clamp include structure for preventing rotation of the clamp with respect to the wall.

4 Claims, 1 Drawing Sheet

STRAIN RELIEF ASSEMBLY

This invention relates to electrical wiring apparatus and, more particularly, to a strain relief assembly for holding an electrical cable as it passes through a wall of a metallic electrical equipment housing.

BACKGROUND OF THE INVENTION

It is necessary to protect an electrical cable where it passes through an opening in a wall of a metallic housing to prevent a possible sharp edge of the metal defining the opening from abrading the outer protective sheath of the cable or even severing the insulation about an electrical conductor thereby possibly causing an electrical short. One way to provide this protection is to line the opening with a resilient insulative grommet. However, such a grommet does not hold the cable. Thus, if a pulling force is applied to the cable, this force is resisted by the electrical conductors of the cable where they are attached to terminals inside of the housing. The result could be that the electrical conductors become disconnected, possibly resulting in a short or making the metal housing live.

Often strain relief clamps are provided to hold the cable where it passes through the wall. The clamp functions to resist any pulling forces so that they are not reflected at the electrical terminations. Such a strain relief clamp could include a U-shaped receiver defining a cavity for receiving the cable and an insert for closing the cavity and pushing the cable towards the base of the receiver to effect bending of the cable. When the strain relief clamp is inserted into the opening, the cable is firmly held and the clamp not only resists pulling of the cable but also is locked against longitudinal movement with respect to the housing wall which holds the clamp.

Such a clamp, however, does not prevent rotation of the clamp in the circular opening in which the clamp is located. The wall opening must be substantially circular because it must be able to accommodate the passage of a pipe as some electrical codes require the wiring to be in a conduit. An example of a known two-piece strain-relief clamp is part No. 7 K -2 made by the Heyco Manufacturing Company. Unrestricted rotation of the clamp can result in the portion of the cable disposed inside of the housing becoming twisted which could again result in various forces being applied to the terminations of the electrical conductors which could cause, in an extreme case, disconnection of the conductors from the terminals. In certain applications, such as a enclosure for an electric garage door opener motor, where there is vibration attendant the operation of the equipment, Canada and various European countries are requiring that the cable is held from rotation with respect to the housing.

SUMMARY OF THE INVENTION

Among the several aspects and features of the present invention may be noted the provision of an improved strain relief clamp assembly. The strain relief clamp is easily inserted in the opening of the housing wall and functions to provide a bend in the compressibly held cable to resist pull-out forces. Additionally, the strain relief clamp cooperates with the hole pattern in the wall to lock the held cable against rotation. The strain relief clamp of the present invention is reliable in use, has long service, and is relatively easy and economical to manufacture. Other aspects and features of the strain relief clamp will be, in part, apparent and, in part, pointed out specifically hereinafter in the following specification and accompanying drawings.

Briefly, the strain relief clamp assembly of the present invention includes a housing wall having a substantially circular opening for passage of the electrical cable. The assembly further includes a strain relief clamp for mounting in the opening. This clamp includes a generally U-shaped receiver of one-piece molded thermoplastic construction defining an open ended cavity for receiving the cable. The clamp also includes an insert also of one-piece molded thermoplastic construction for slidable reception by the receiver to close the open end of the cavity. The receiver and insert cooperate to hold the cable by forming a bend in the cable with the resiliency of the cable urging the insert outwardly. The housing wall and the clamp include structure for preventing rotation of the clamp with respect to the wall. In the preferred embodiment, the anti-rotation structure includes a keyway adjoining the housing wall opening and a key on the strain relief clamp for reception in the keyway.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
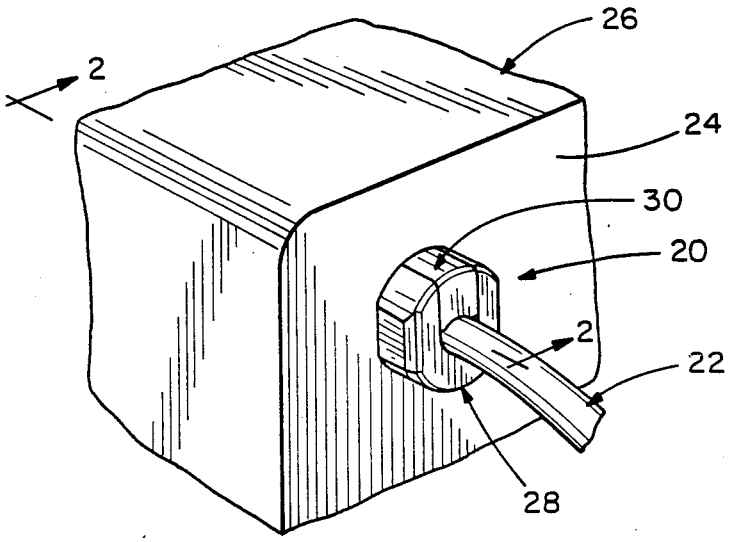
FIG. 1 is a perspective view of a strain relief assembly embodying various features of the present invention to protect an electrical cable as it passes into a housing for electrical equipment.

Referring now to the drawings, a strain relief clamp 20 for holding an electrical cable 22 where the cable passes through a wall 24 of an electrical equipment housing 26, is generally indicated by reference numeral 20 in the drawings. The housing could be for enclosing the electrical motor and certain drive components for a garage door operator.

More specifically, the clamp 20 is of one-piece molded thermoplastic construction and includes a generally U-shaped receiver 28 and an insert 30 which is joined to the receiver by a filament 32, so that the installer is not required to keep track of multiple pieces. The receiver includes an open-ended cavity 34 for receiving the cable. The insert is slidably received by the receiver to close the open end of the cavity to hold the cable by forming a bend in the cable.

Figure 2:
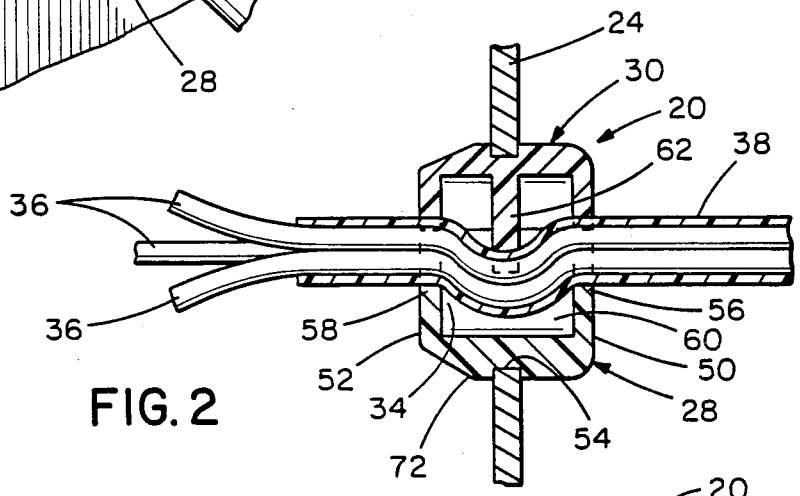
FIG. 2 is a cross-sectional view of the clamp assembly illustrating the cable being deformed as it passes into the housing.
Figure 6:
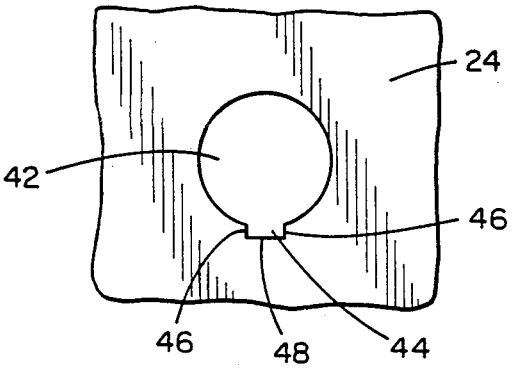
FIG. 6 is a front elevational view of the housing wall depicting an opening and adjoining keyway for receiving the clamp.

As best shown in FIG. 2, the cable 22 includes conductors 36 and a resilient insulative outer jacket 38 encompassing the conductors. Referring to FIG. 6, the wall 24 of the housing has an opening 42 which is substantially circular with a keyway 44 adjoining the opening. This keyway is generally rectangular and is defined by a pair of spaced side surfaces 46 and a base surface 48 joining the side surfaces.

Referring to FIG. 2, the clamp includes a trailing end 50 which is enlarged for abutting the wall 24 to limit insertion of the clamp through the opening. The clamp further includes a tapered leading end 52 for bearing against the wall material defining the opening 42 to cause the insert to be urged inwardly as the clamp is pushed into the opening. The clamp further includes a slot means 54 disposed between the leading and trailing ends. The material defining the opening is received in the slot means when the clamp is mounted in the opening so that both the trailing end and the leading end 52 overlap the wall material to positively locate the clamp 20 in the wall 24.

Figure 3:
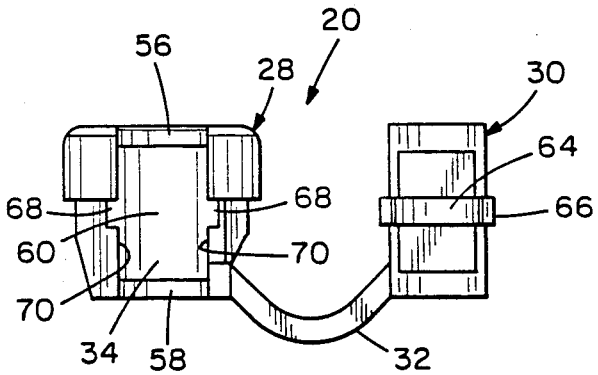
FIG. 3 is a plan view of a receiver and an insert, which together form the strain relief clamp, in their unassembled condition.
Figure 4:
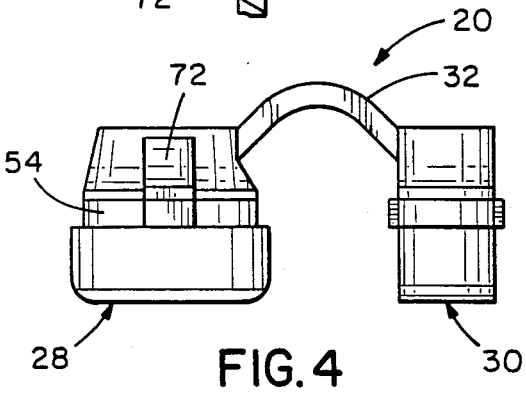
FIG. 4 is a bottom view of the receiver and the insert.
Figure 5:
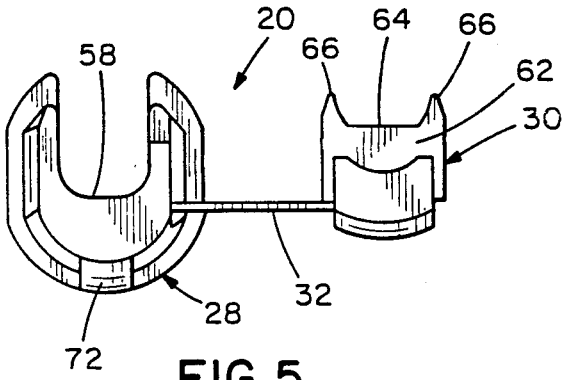
FIG. 5 is a front elevational view of the receiver and the insert.

Referring to FIGS. 3 and 5, the receiver includes a first ledge 56 at its trailing end and a second ledge 58 at its leading ledge, with a depression 60 extending from the cavity 34 beneath the level of the ledges 56 and 58.

The insert 30 includes a central wall 62 having a leading end which is bifurcated. There is a pusher surface 64 disposed between the leading arms 66 with the arms serving to hold and direct the cable against the pusher surface. This central wall has a width slightly greater than that of other components of the insert so that the central wall transverse portions can extend into a pair of spaced slots 68 on the inner side surfaces 70 of the receiver to locate and guide sliding movement of the insert with respect to the receiver. With the cable positioned on the ledges 56 and 58 and the insert received by the receiver, movement of the insert toward the ledges results in the pusher surface 64 engaging the cable to cause a bend in the cable thereby deforming it and firmly holding the cable. Of course the cable, due to its resiliency, tends to urge the insert outwardly. This results in the mounted clamp substantially filling the opening 42 in the housing wall.

The receiver carries a key 72 for reception in the keyway 44, generally opposite the opening of the cavity 34. This key 72 includes a tapered portion at the leading end 52 of the clamp and further includes a component of the slot means for receiving the base surface 48 defining the keyway.

Operation of the strain relief clamp of the present invention is as follows: With the cable conductors 36 connected to the appropriate terminals inside the housing 26 and with the cable extending through the opening 42, the cable can be placed in the cavity 34 of the receiver 28. The insert central wall 62 is positioned in the slots 68 of the side surfaces 70 and the insert is pushed towards the receiver until the tapered leading end 52 can be partially moved into the opening with the key 72 received in the keyway 44. By pushing the leading end 52 of the assembled clamp against the material defining the opening, the insert is forced inwardly, further bending the cable until the leading end passes the material defining the opening at which time the cable, due to its resiliency, forces the insert outwardly slightly so that the material defining the opening is received in the slot means between the leading and trailing ends. Of course, the enlarged trailing end 50 limits the insertion. The result is that the clamp is held against axial movement and further that the clamp is held against rotation with the key received in the keyway. Thus, there is no possibility of rotation of the cable and any force applied to the cable is resisted by the strain relief and housing wall to prevent any force from being applied to the terminals to which the conductors of the cable are attached.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A strain relief assembly for firmly holding an electrical cable, including at least one electrical conductor and a resilent insulative outer jacket encompassing the conductor, as the cable extends inside a housing for electrical equipment, said assembly comprising:

a housing wall having a circular opening for passage of said cable, said opening being adapted to receive a circular pipe which substantially fills said opening with said pipe being rotatable in said opening; and a strain relief clamp for mounting in said opening and including a generally U-shaped receiver of one-piece molded thermoplastic construction defining an open-ended cavity for receiving said cable, said clamp further including an insert of one-piece molded thermoplastic construction for slidable reception by said receiver to close the open end of said cavity to hold said cable by forming a bend in said cable, the resiliency of said cable urging said insert outwardly, said housing wall and said clamp including means for preventing rotation of said clamp with respect to said wall, said means for preventing rotation comprising a keyway in said housing wall adjoining said opening, said means for preventing rotation further comprising a key on said strain relief clamp for reception in said keyway whereby said housing wall can either accept said clamp with the prevention of relative rotation or can accept a circular conduit pipe with allowance of relative rotation.

2. A strain relief assembly as set forth in claim 1 wherein said receiver carries said key.

3. A strain relief assembly as set forth in claim 1 wherein said keyway is generally rectangular and is defined by a pair of spaced side surface and a base surface joining said side surfaces, said key being configured to substantially fill said keyway when said clamp is mounted in said opening.

4. A strain relief assembly as set forth in claim 1 wherein said strain relief clamp includes an enlarged trailing end for abutting said wall to limit insertion of said clamp through said opening, a tapered leading end for bearing against the wall material defining said opening to cause said insert to be urged inwardly as said clamp is pushed into said opening, and a slot means disposed between said leading and trailing ends, the material defining said opening being received in said slot means when said clamp is mounted so that both ends overlap said material to positively locate said clamp in said wall, said key including components of both said leading end and said slot means.

* * * * *